US005326069A

United States Patent [19]

Clear et al.

[11] Patent Number: 5,326,069

[45] Date of Patent: Jul. 5, 1994

[54] VACUUM TOILET SYSTEM AND DISCHARGE VALVE THEREOF

[75] Inventors: Christopher J. Clear, Columbia City; John M. Grooms, Rochester, both of Ind.

[73] Assignee: Burton Mechanical Contractors, Inc., Rochester, Ind.

[21] Appl. No.: 967,454

[22] Filed: Oct. 28, 1992

[51] Int. Cl.[5] ..... F16K 31/145

[52] U.S. Cl. ..... 251/61.5; 251/61.1; 137/907

[58] Field of Search ..... 251/61.5, 61.1; 137/907

[56] References Cited

U.S. PATENT DOCUMENTS

| | | | |
|---|---|---|---|
| 2,746,471 | 5/1956 | Cobb | 251/61.1 |
| 2,749,080 | 6/1956 | Griswold | 251/61.5 |
| 3,083,943 | 4/1963 | Stewart, Jr. et al. | 251/61.1 |
| 5,082,238 | 1/1992 | Grooms et al. | 251/61.5 |

*Primary Examiner*—A. Michael Chambers

*Attorney, Agent, or Firm*—Jones, Day, Reavis & Pogue

[57] ABSTRACT

A vacuum toilet system for efficient transport of waste material from a toilet bowl to a collection station by means of differential pressure, comprising an actuator button, a discharge valve, a water valve, and a controller valve. The various valves are simple in construction and operate on the basis of pneumatic pressure. The system is compact enough to fit into the cabinet of a conventional toilet fixture.

7 Claims, 10 Drawing Sheets

VACUUM TOILET SYSTEM AND DISCHARGE VALVE THEREOF

BACKGROUND OF THE INVENTION

The present invention relates generally to systems for removing human waste from a toilet bowl by vacuum pressure and rinsing it thereafter, and more particularly to a system in which the discharge valve, water valve, and controller valve are operated by means of differential pressure.

In a conventional toilet system, the toilet bowl is connected to a holding sump by means of a drain pipe. Human waste in the toilet bowl, be it liquid or solid, is evacuated to the drain pipe, and thereby to the holding sump when the water already in the bowl is evacuated to the drain pipe by gravity, and new water is flushed into the bowl to rinse it. The waste material in the holding sump, in turn, may be transported to a collection tank by a number of means, including gravity flow, positive pressure flow, or vacuum pressure, depending upon the topography of the terrain. U.S. Pat. No. 4,179,371 issued to Foreman et al. discloses a vacuum transport system, using two-phase flow and equalized pressure communication throughout the transport conduit generally upon completion of a vacuum transport cycle.

The source of vacuum pressure may also be communicated directly to the toilet bowl so that the waste matter is withdrawn under the influence of differential pressure to the holding sump or directly to the vacuum transport conduit. Such a vacuum toilet system may be more compact in design (and thereby suitable for mobile settings such as airplanes and trains) because of smaller pipe requirements, flexibility of routing due to lift characteristics (vacuum transport conduit may be routed over, under, or around obstacles unlike gravity systems), and it conserves rinse water, because water is not required to provide positive pressure for pushing the waste material out of the toilet bowl during discharge. U.S. Pat. No. 3,922,730 issued to Kemper; U.S. Pat. No. 3,995,328 issued to Carolan et al.; U.S. Pat. No. 4,199,828 issued to Hellers; and U.S. Pat. No. 4,276,663 issued to Gensurowsky, as well as U.K. Published Application Nos. 2,194,260 and 2,203,461 provide examples of such vacuum toilets and systems.

Discharge valves in such systems have used simple flap doors which are opened either by means of the weight of the waste material (Hellers, or U.S. Pat. No. 4,184,506 issued to Varis et al.), or by means of differential pressure (U.S. Pat. No. 4,296,772 issued to Nilsson). However, such closure mechanisms may easily become lodged in the open position to impair the return of a vacuum pressure condition to the vacuum transport conduit downstream of the flap valve.

In the alternative, purely mechanical closure means have been incorporated into a discharge valve, such as a plunger operated by a pivotable latch (U.S. Pat. No. 4,621,379 issued to Kilpi), a reciprocating closure which pinches a flexible hose (U.S. Pat. No. 4,376,314 issued to Iwans; and U.S. Pat. No. 4,783,859 issued to Rozenblatt et al.), or a rotated disk which seals and unseals an aperture (U.S. Pat. No. 4,713,847 issued to Oldfelt et al.). Such purely mechanically operated discharge valves, though, are subject to excessive wear and tear, and provide imperfect seals of the vacuum transport conduit downstream thereof.

Therefore, resort has been made to discharge valve closure members having a chamber defined by a diaphragm connected to piston rod to seal the valve upon the application of differential pressure across the diaphragm. (See, e.g. U.S. Pat. No. 3,788,338 issued to Burns; U.S. Pat. No. 3,807,431 issued to Svanteson; U.S. Pat. No. 4,376,315 issued to Badger et al.; U.S. Pat. No. 4,041,554 issued to Gregory et al.; and U.K. Patent No. 1,538,820 issued to Electrolux GmbH.) But, the diaphragm is easily ruptured against the internal valve body during closure, and the valve housing is space-consuming due to the tapered profile of the housing required to assist in the application of differential pressure to differing cross-sectional areas to overcome the force applied by a spring bearing against a portion of the piston rod adjacent to the diaphragm. The use of a diaphragm activated reciprocating pin in U.S. Pat. No. 4,057,076 issued to Varis et al. to dislodge a ball which closes a valve opening provides an extremely inefficient alternative.

As for controller mechanisms used to activate discharge valves in vacuum toilet systems, floats (Svanteson and Varis), solenoids (Badger and Burns), pressure switches (U.S. Pat. No. 4,520,513 issued to Raupuk, Jr. et al.), electromechanical devices (Rozenblatt), and simple two-position dial valves (Electrolux) have been used. An extremely complicated push button actuator valve is disclosed in Gregory.

SUMMARY OF THE INVENTION

Accordingly, it is an object of the invention to provide a vacuum toilet system, which can evacuate waste material from a toilet bowl by means of vacuum pressure.

Another object of the present invention is to provide such an apparatus having a discharge valve, water valve, and controller valve which are completely operated by means of differential pressure.

Yet another object of the present invention is to provide such an apparatus, which is compact enough to fit in a china toilet cabinet, may be applied to mobile or stationary environments, and has a minimum number of mechanical parts subject to breakage.

Still another object of the present invention is to provide an operable discharge valve, which does not employ a reciprocating piston shaft, and therefore is smaller than conventional vacuum valves.

These and other objects may be more easily understood by resort to the description of the invention contained herein, in conjunction with the accompanying drawings.

Briefly, the invention is directed to providing a vacuum toilet system for efficient transport of waste material from a toilet bowl to a collection station by means of differential pressure. It comprises an actuator button, a discharge valve, a water valve, and a controller valve. The various valves are simple in construction, and operate on the basis of pneumatic pressure. The system is compact enough to fit into the cabinet of a conventional toilet fixture.

DETAILED DESCRIPTION OF THE PREFERRED EMBODIMENT

Figure 1:
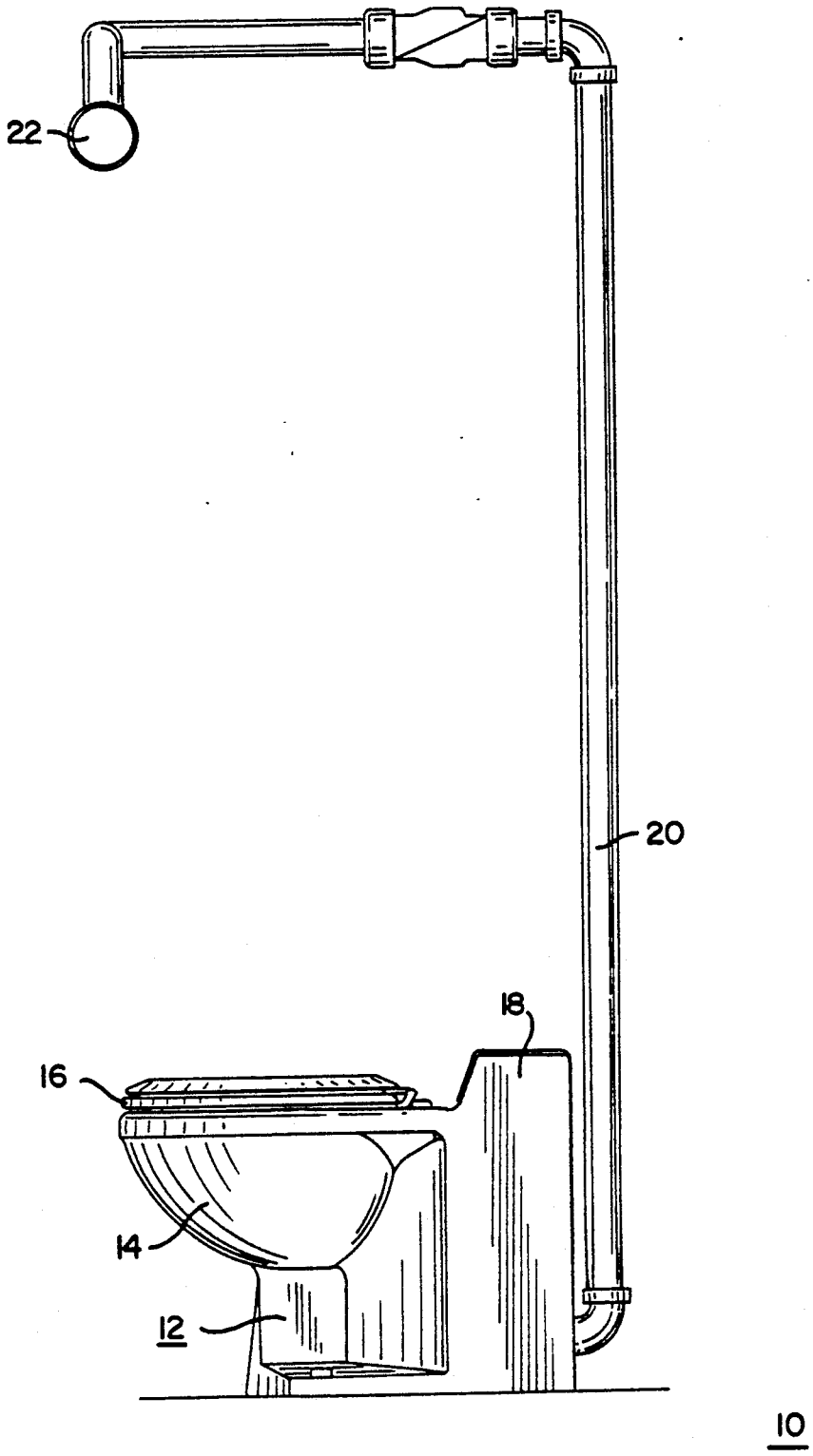
FIG. 1 shows the vacuum toilet system of the present invention.

As illustrated in FIG. 1 of the drawings, a vacuum toilet system 10 comprises a conventional vitreous china cabinet 12 having a toilet bowl 14 supporting a seat 16, and a housing 18 mounted behind the bowl 14. A pipe 20 is connected to cabinet 12, the other end of pipe 20 being connected to a vacuum transport conduit 22 maintained at vacuum or subatmospheric pressure.

Figure 2:
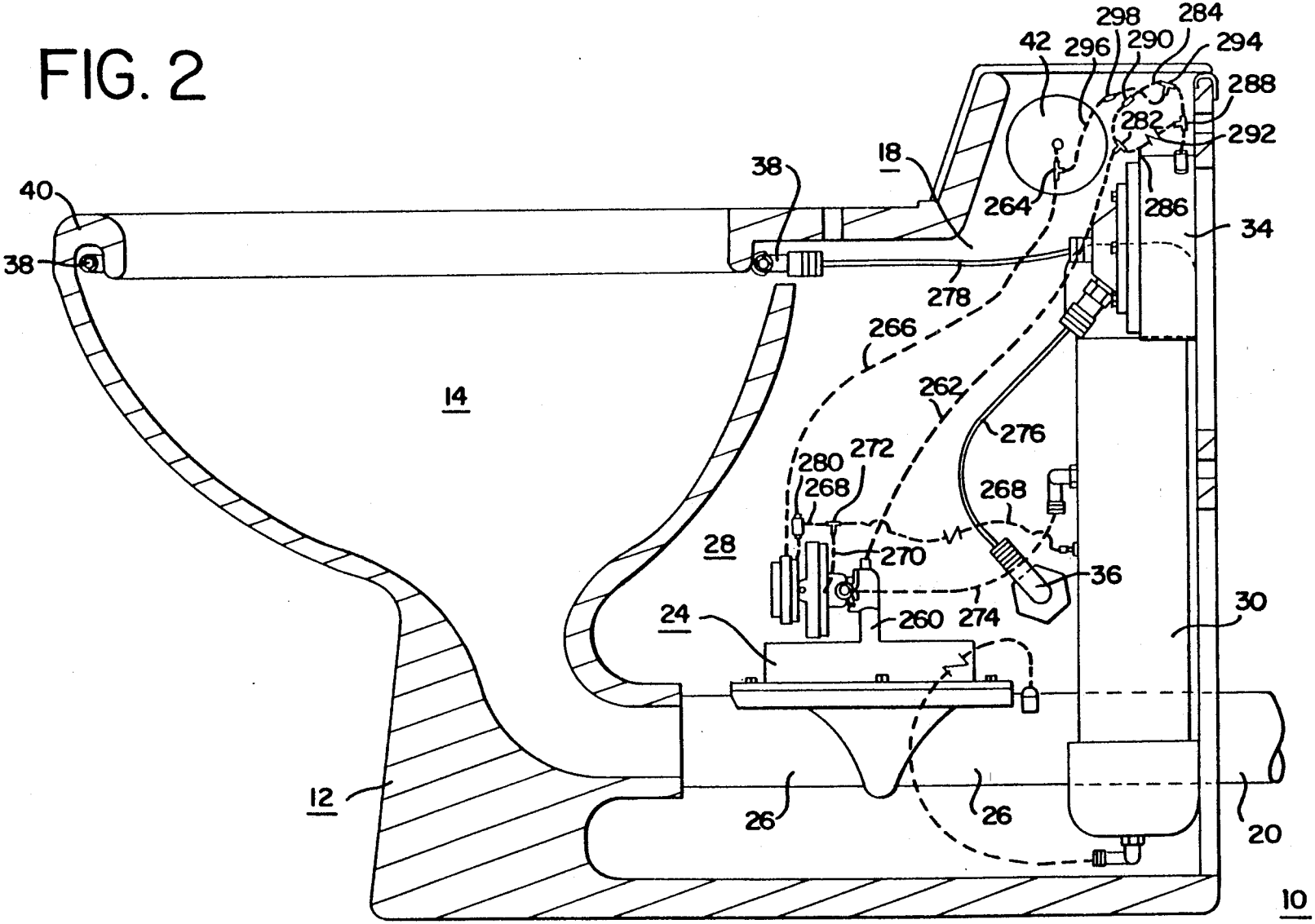
FIG. 2 shows a sectional view of a portion of the system shown in FIG. 1.

FIG. 2 illustrates the components within housing 18 in greater detail. Discharge valve 24 is interposed in pipe 26 which, in turn, is connected to discharge pipe 20. It permits vacuum or subatmospheric pressure to be introduced to toilet bowl 14 to withdraw waste material contained therein when discharge valve 24 is in the open position. Controller valve 28, in turn, is mounted to discharge valve 24, and provides atmospheric or vacuum/subatmospheric pressure to the discharge valve to close or open it, respectively, depending upon whether controller valve 28 is in the standby or actuated position, respectively. Vacuum reservoir 30 provides a reliable volume of vacuum/subatmospheric pressure to controller valve 28.

Controller valve 28 also regulates the operation of water valve 34, which delivers water from water inlet 36 to spray ring 38 mounted along the upper, interior lip 40 of toilet bowl 14 during a flush cycle when water valve 34 is in the open position. Finally, push button actuator 42 provides the motivational impetus to controller valve 28.

Figure 3:
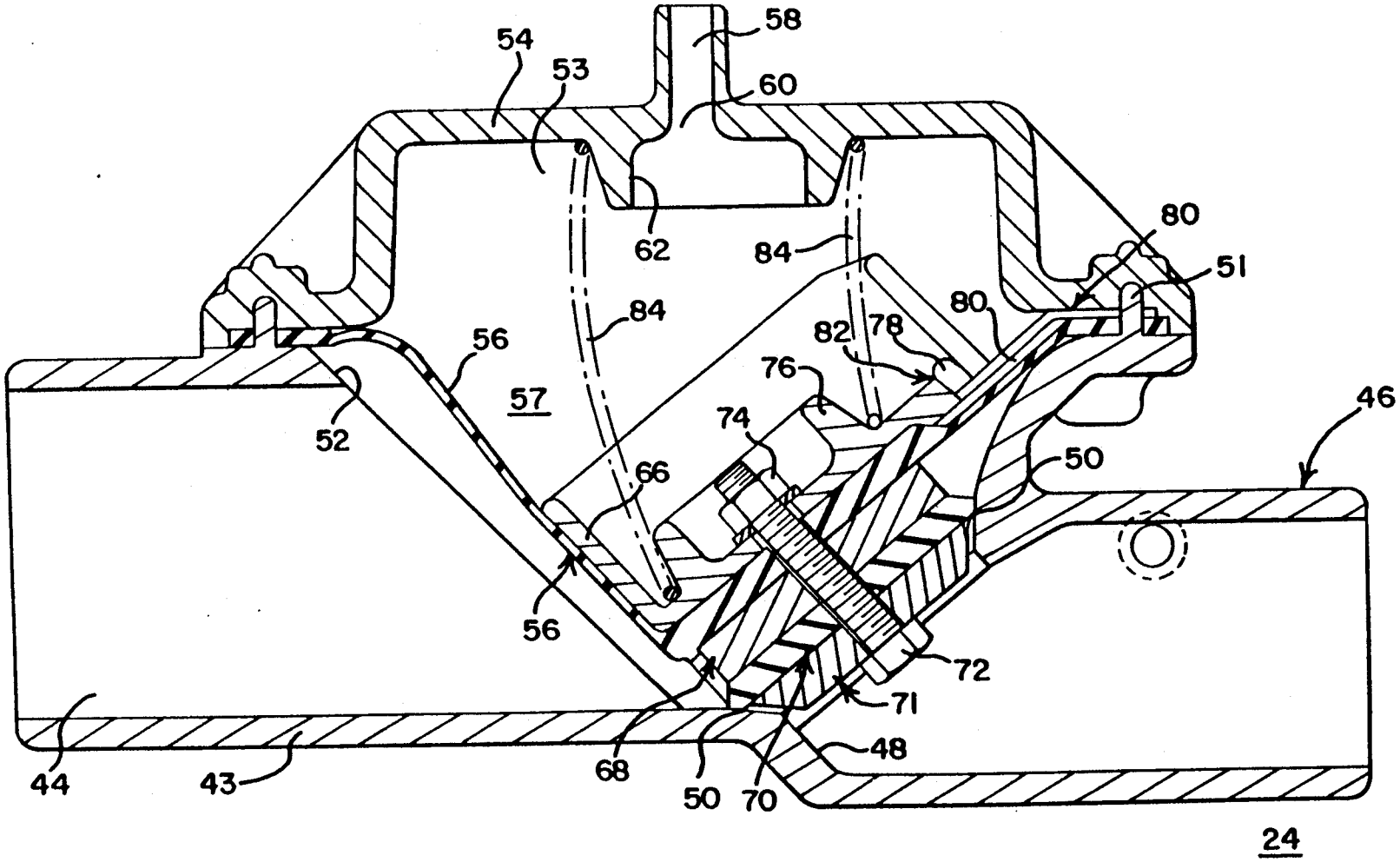
FIG. 3 shows a sectional view of the discharge valve in the closed, standby position.

FIG. 3 illustrates discharge valve 24 in its standby, closed position. It may comprise an offset flow conduit 43 having an inlet portion 44 and an outlet portion 46, the longitudinal axis of each being nonconcentric. The diameter of inlet portion 44 is larger than outlet portion 46 in order to accommodate larger flows of waste liquid through the valve, and eliminate sharp corners in the pipe. Valve stop 50 is situated along flow conduit 43 between the inlet and outlet portions of the conduit.

An opening 52 is formed in the top portion of flow conduit 43. Secured thereof by suitable means is bonnet 54. Although nuts and bolts are shown in the embodiment of FIG. 3, it should be understood that alternate means, such as a "twist on" locking mechanism could also be used. The conduit and bonnet portions of the discharge valves must handle harsh environments in normal applications, so they should be made from suitable materials like ABS, polyethylene, polypropylene, or PVC.

The edges of flexible diaphragm 56 are secured between bonnet 54 and flow conduit 43 so that a pressure-tight chamber 57 is defined by the diaphragm and bonnet. Spigot 58 extends from a point on the exterior surface of bonnet 54, and defines inlet 60 in the top of the bonnet. Depending from the interior surface of the top of bonnet 5 is ring wall 62 in nonconcentric relation with the diameter of bonnet 54, the purpose of which will become apparent shortly.

A portion of diaphragm 56 is sandwiched between piston cup 66 and seat spacer 68. Valve seat 70 is positioned adjacent to seat spacer 68, and seat retainer 71, in turn, is positioned adjacent to the other side of the valve seat. The shank of bolt 72 passes through the seat retainer, valve seat, seat spacer, diaphragm, and piston cup, whereupon a nut 74 is threaded to secure all of these parts in tight engagement.

A ring wall 76 extends from the interior surface of piston cup 66 and around nut 74. Ring wall 76 is not concentric with respect to the diameter of piston cup 66. Flange 78 on flex strip 80 is lodged in aperture 82 in the bottom of piston cup 66, the other end of the flex strip being secured between the locating pin 51 and bonnet 54. Spring 84 is positioned inside the valve chamber 5 formed by bonnet 54 and diaphragm 56, one end being held by ring wall 62 and the other end secured by ring wall 76.

The geometry of valve stop 50 is such that the side edges of seat retainer 71 mate precisely. Valve seat 70 is made from a rubber-like compound like EPDM, and extends beyond the edges of seat spacer 68 and seat retainer 71 so that it is pressed against valve stop 50 when discharge valve 24 is in the closed position to prevent migration of waste material through the valve stop, and provide a pressure-tight seal so that vacuum or subatmospheric pressure may be established in the vacuum transport conduit 20 immediately downstream of the discharge valve. Moreover, the nonconcentric geometries of ring wall 62 on bonnet 54 and ring wall 76 in piston cup 66 are such that spring 84 pivots valve seat 70 against valve stop 50 in an arc defined by the length of flex strip 80. The pivotable valve seat and plunger allow use of a smaller valve housing 57 than is possible with prior art vacuum valves having piston shafts.

Diaphragm 56 should be made from a flexible, but resilient rubber-like material, such as EPDM to allow the necessary degree of movement during repeated reciprocation of discharge valve 24 between the open and closed positions. Flex strip 80 should be made from a flexible plastic acetyl material like DELRIN sold by DuPont to permit flexibility without undue stretching over time.

It should be understood that other discharge valve designs will function equally well in the vacuum toilet system of the present invention. One such design is disclosed by U.S. Pat. No. 5,082,238 issued to the assignee of the present application, and the teachings thereof are incorporated herein by reference in full.

Figure 5:
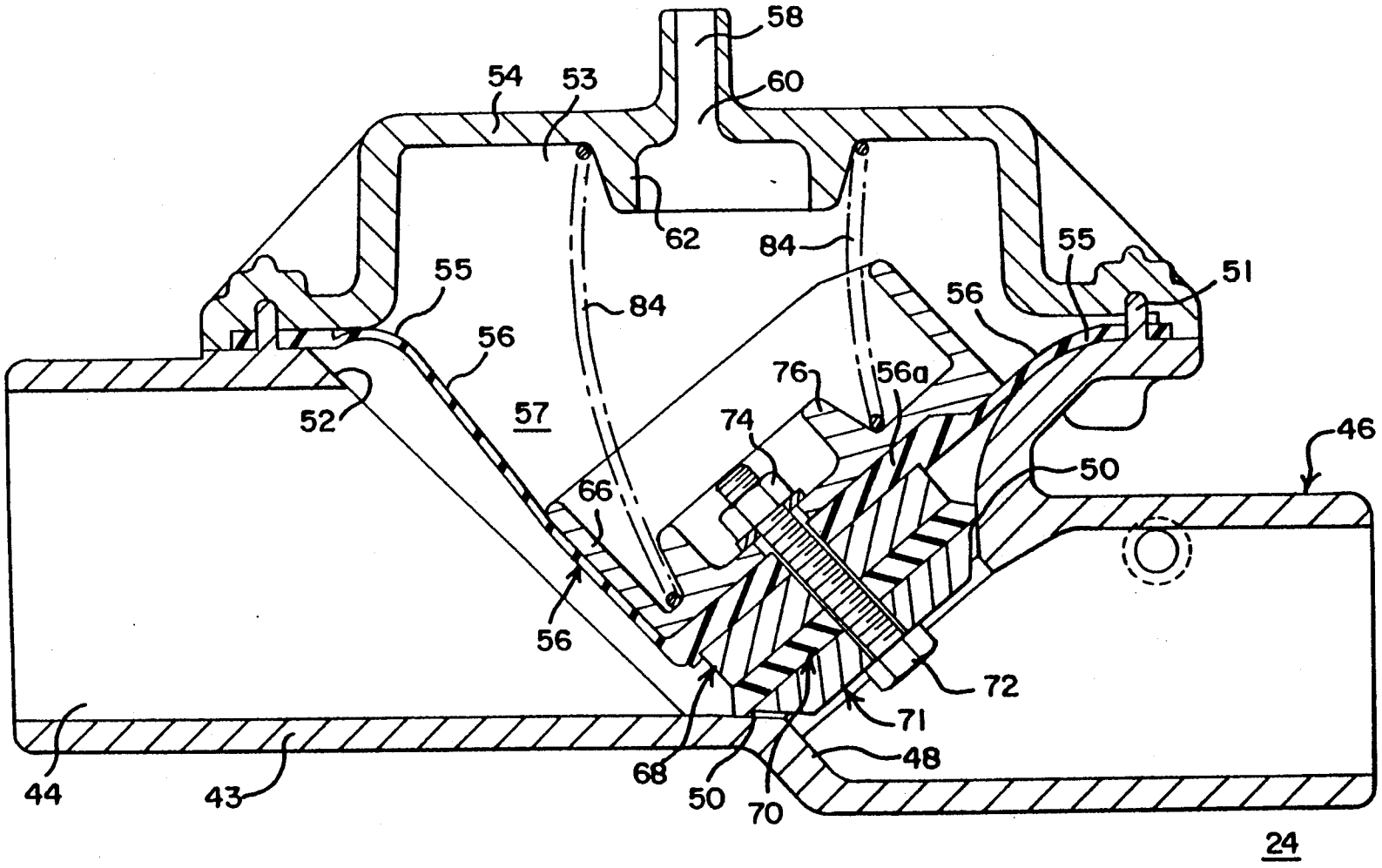
FIG. 5 shows a sectional view of another embodiment of the discharge valve in the closed, standby condition.

Another alternate embodiment of discharge valve 24 is shown in FIG. 5. Like parts have been marked with like numbers for identification purposes. Instead of flex strip 80, diaphragm 56 has a reinforced flex area 56*a* along the one side, as more clearly shown in FIGS. 6–7. Diaphragm 56 depends from a reinforced perimeter collar 55 to feature sides 55*a* and 55*b* in cross-sectional view (see FIG. 6), which meet collar portion 55 at approximately a 45° angle when extended during discharge valve closure. A vertical portion of side 55*b* is thickened to define flex area 56*a*. For a 1½-inch diameter valve stop 50, flex area 56*a* should be approximately ⅔ the size of the valve aperture, and 2 to 3 times the thickness of the rest of the diaphragm wall. Because this reinforced flex will not stretch as much as the rest of diaphragm wall during valve operation, it can control the arc of movement of the valve seat during reciprocal operation. It has been found that this reinforced flex area 56*a* is more durable than plastic flex strip 80 during repeated valve operation.

Figure 5A:
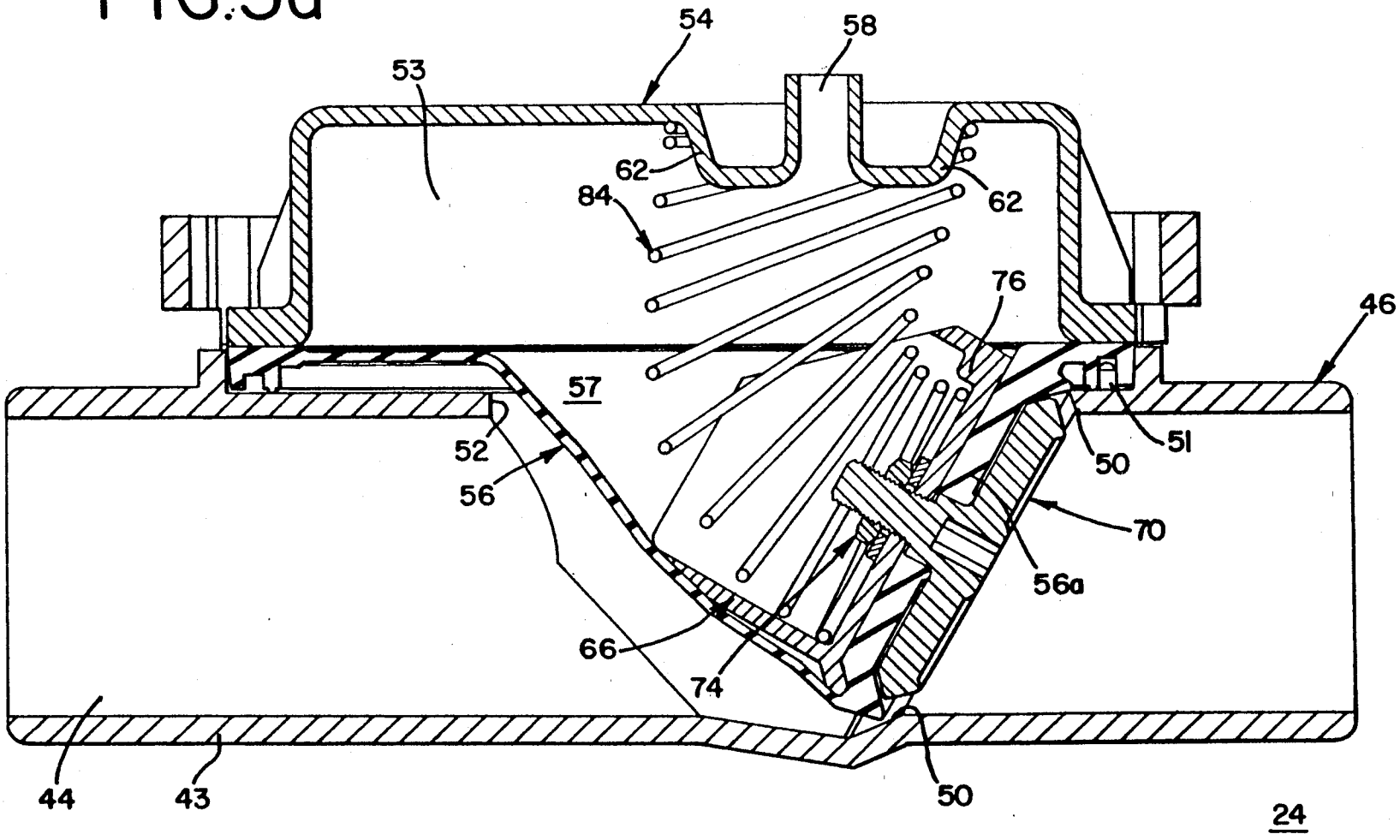
FIG. 5*a* shows a sectional view of yet another embodiment of the discharge valve in the closed, standby position.

The discharge valve of FIG. 5 could also have concentric inlet and outlet pipes 44 and 46 to provide a "straight through" flow path as shown in FIG. 5*a* wherein like element numbers have been retained. It has also been found that these pipes can be made of the same diameter, while accommodating waste material flows.

Figure 8:
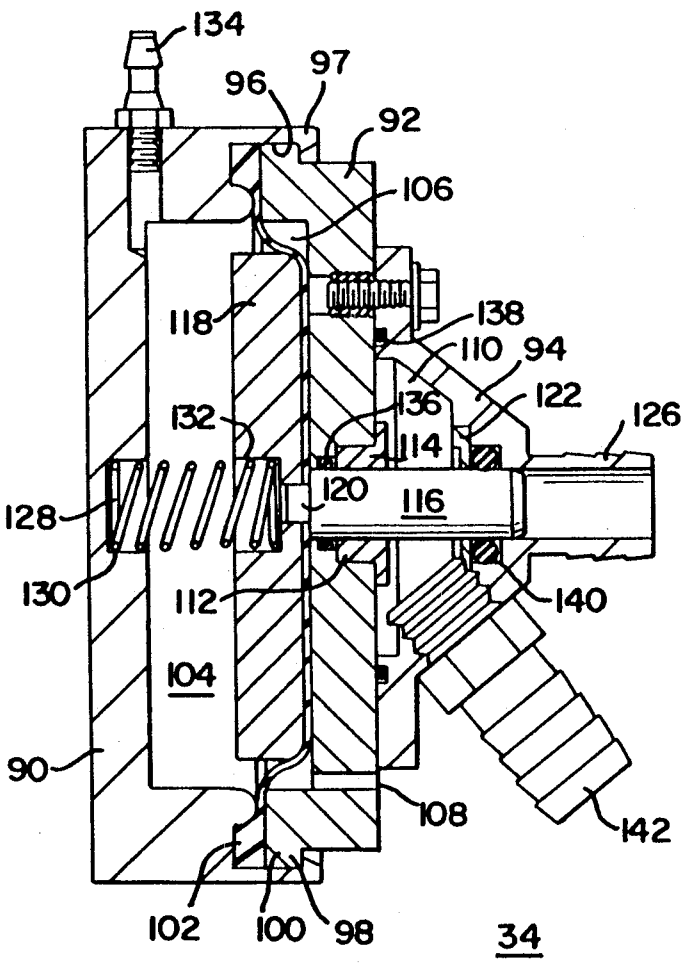
FIG. 8 shows a sectional view of the water valve in the closed, standby position.

Water valve 34 is shown in FIG. 8 in the closed, standby position. It comprises an upper housing 90, middle housing 92, and lower housing 94. Upper and middle housings 90 and 92, respectively, are snap fit together by means of flange 96 defining an annular region 97 in the wall of upper housing 90, and flange 98 extending from middle housing 92 and providing a step 100. The edges of flexible diaphragm 102 made of a rubber-like material like EPDM, are secured inside annular region 97 so that two separate pressure-tight chambers 104 and 106 are created. Atmospheric vent 108 in the side of middle housing 92 ensures that chamber 106 is always maintained at atmospheric pressure.

Lower housing 94 is secured to the exterior surface of middle housing 92 to define a water-tight chamber 110. A stepped passage 112 in the wall of middle housing 92 accommodates a bearing 114 through which passes plunger 116. One end of plunger 116 is secured to diaphragm 102 and piston plate 118 by means of screw 120. Another bearing 122 is incorporated into a recess 124 in the wall of lower housing 94, which is adjacent to water outlet 126. Spring 128 secured at either end by niche 130 in the interior surface of upper housing wall 90 and niche 132 in piston plate 118 biases plunger 116 past bearing 122 to seal off water outlet 126 when the pressure communicated through vent inlet 134 into chamber 104 is atmospheric pressure. Rubber gaskets 136, 138 and 140 provide liquid-tight seals along water chamber 110. Finally water inlet 142 in the side of lower housing 94 provides means for introducing water into water chamber 110.

Figure 10:
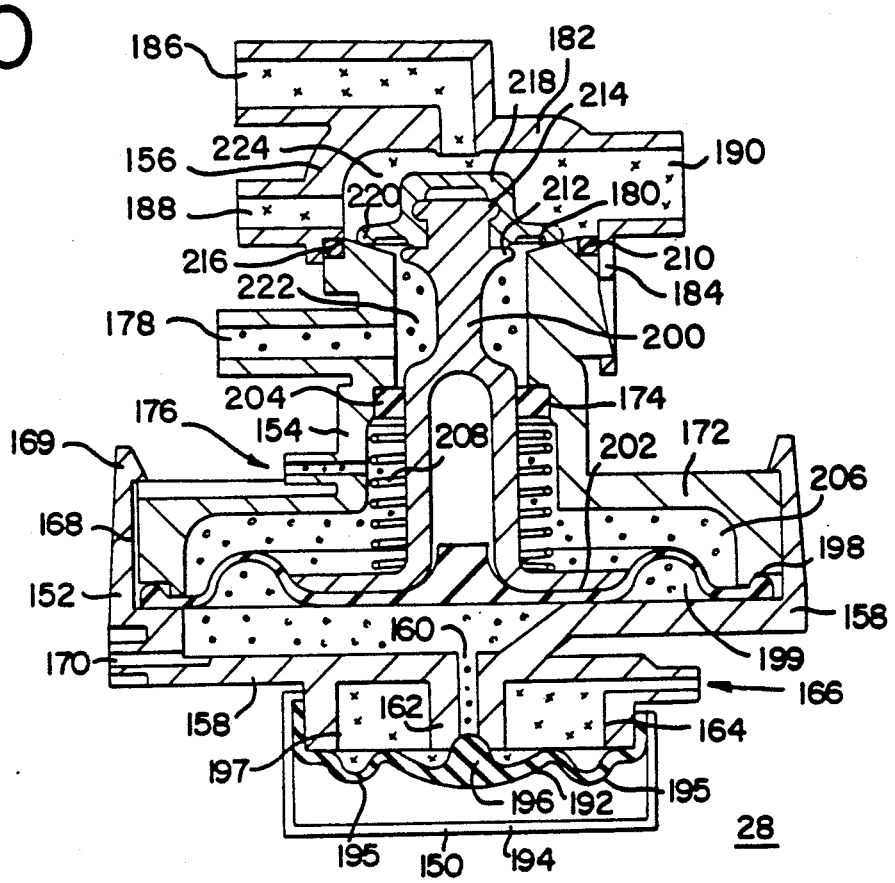
FIG. 10 shows a sectional view of the controller valve in the standby position.
Figure 11:
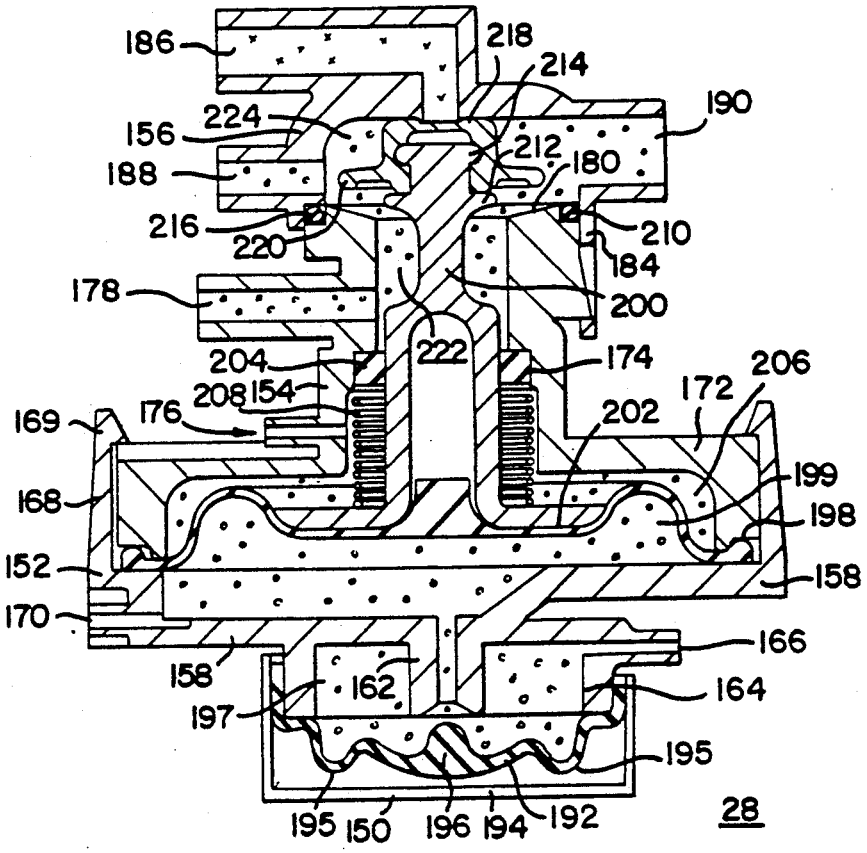
FIG. 11 shows a sectional view of the controller valve of FIG. 10 in the actuated position.

The structure of controller valve 28 is shown in FIGS. 10 and 11. It comprises a first housing 152, second housing 154, and third housing 156. First housing 152 features an irregularly-shaped base portion 158 having an aperture 160 therein, a ring wall 162 depending from the base adjacent aperture 160, side wall 164 depending from the perimeter of base 158 and having sensor inlet 166 connected thereto, and ring wall 168 extending from the perimeter of the upper side of base 158, terminating in flanges 169 at the distal end thereof, and having vacuum inlet 170 connected thereto.

Second housing 154 is bell-shaped, and has skirted portion 172, niche 174, vacuum inlets 176 and 178, and a chamfered surface along the distal end thereof, constituting valve stop 180.

Finally, third housing 156 is cup-shaped, having a wall 182, a flanged lip 184 along the distal end thereof, atmospheric inlet 186, and outlet vents 188 and 190.

Flexible diaphragm 192 fits around side wall 164 of first housing 152 and is secured in place by frictional force due to stretch fitting the outer ring wall of the diaphragm 192 over the ring wall 164 of the first housing 152. Diaphragm 192 is made from a rubber-like material like EPDM, has curved rib 195 on the outer surface to promote flexibility, and has nib 196 at the center of the inner surface of the diaphragm to interact with ring wall 162 to provide a seal. Diaphragm 192, base 158, side wall 164, and ring wall 162 combine to form sensor chamber 197.

Meanwhile, first housing 152 and second housing 154 are snap-fitted together, retaining flexible diaphragm 198 therebetween to define chamber 199. Plunger rod 200 terminating in piston plate 202 is retained inside second housing 154, the bottom surface of the piston plate being held against diaphragm 198 by spring 208. Rubber gasket 204 is positioned inside niche 174 to provide an air and liquid-tight seal between the plunger rod 200 and inner surface of second housing 154, and define a chamber 206. Spring 208 is positioned between piston plate 202 and a washer 173 which rests against the flanged housing wall defining niche 174. The spring biases diaphragm 198 toward the end cap 194 of controller valve 28.

Third housing 156 is snap-fitted into engagement with second housing 154, and gasket 210 provides an air and liquid-tight seal therebetween. The end of plunger rod 200 opposite piston plate 202 extends into third housing 156, and has ringed protrusions 212 and 214 along the perimeter of the end thereof, defining an annular recess 216 therebetween. A cap 218 made from a resilient rubber-like material and having a radiating flange 220 is snapped over the end of plunger rod 200 and secured inside annular recess 216. Vacuum chamber 222 and valve chamber 224 are separated when flange 220 on cap 218 bears against valve stop 180 when controller valve 28 is in the closed position.

Figure 12:
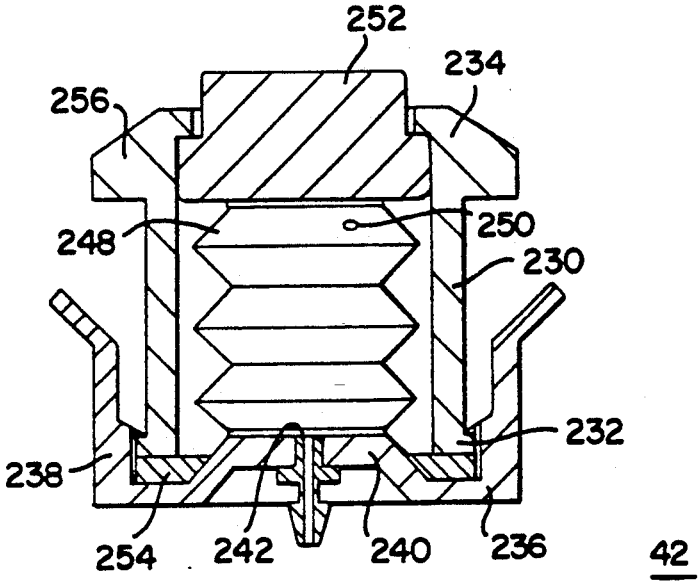
FIG. 12 shows a sectional view of the push button actuator in the standby position.
Figure 13:
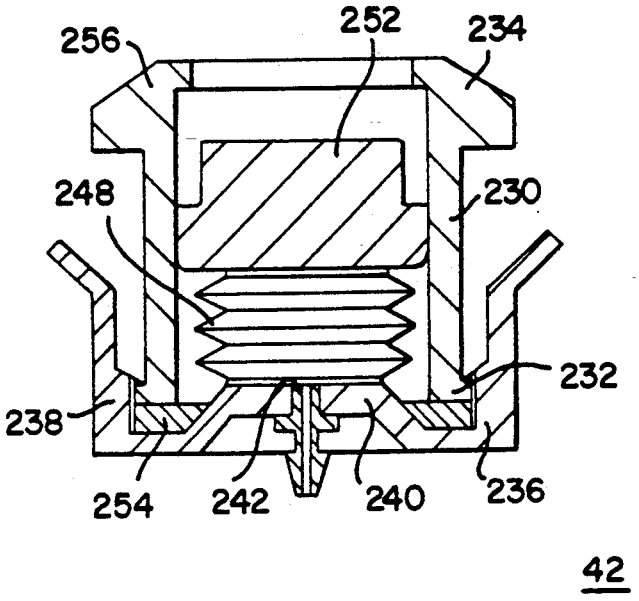
FIG. 13 shows a sectional view of the push button actuator of FIG. 12 in the actuated position.

Push button actuator 42 is illustrated in FIGS. 12 and 13. As shown in FIG. 12 in the standby position, it comprises a housing 230 having open top and bottom portions thereof. The lower edge of housing 230 terminates in external flanged lip 232. The upper edge of housing 230 likewise has a flanged lip 234 except that it radiates towards the axis of the housing.

Base 236 has side wall 238 and raised step 240 along the bottom portion thereof. A hole 242 accommodates outlet nozzle 244. Base 236 and side wall 238 cooperate to form niche 246.

Accordian bellows 248 is made from an elastomeric material, and has multiple collapsible panels. Attached to the upper edge of bellows 248 is push button 252, which is retained by lip 234 of housing 230. Secured to the other end of bellows 248 is base plate 254, which has an annular hole therein and fits around step 240 on housing base 236.

Bellows 248 holds a predetermined volume of atmospheric air. When push button 252 is depressed, bellows 248 is compressed to the activated position shown in FIG. 13, thereby expelling the atmospheric air through outlet hole 242 and nozzle 244. Housing side wall 230 may be provided with an external flange 256 for mounting push button actuator 42 to, e.g., housing 18 of china cabinet 12. Likewise, base 236 may be provided with levers on side wall 238 to facilitate separation of base portion 238 from housing 230 to repair or replace bellows 248.

Referring now to the figures, operation of vacuum toilet system 10 will be described. FIGS. 3, 8, 10, and 12 show discharge valve 24, water valve 34, controller valve 28, and push button actuator 42 in the closed, standby position. FIG. 2 shows the fluidic and pneumatic circuitry of the system.

Plunger rod 200 of controller valve 28 is positioned so that cap 218 bears against valve stop 180 to open the atmospheric vent 186 and close vacuum chamber 222. Thus, atmospheric air in valve chamber 224 is communicated to valve housing 57 of discharge valve 24 and chamber 104 of water valve 34 by means of conduits 260 and 262, respectively.

When push button 252 of push button actuator 42 is depressed, atmospheric air contained in bellows 248 is expelled through T-junction 264 and conduit 266 to sensor chamber 197 of controller valve 28 via base vent inlet 166. The extra volume of atmospheric air is added to the atmospheric air already contained in sensor chamber 197 to deflect nib 196 of diaphragm 192 away from ring wall 162 to communicate the atmospheric air into chamber 199 which is at vacuum/subatmospheric pressure via conduit 268 connected to vacuum reservoir 30. This converts the pressure condition in chamber 199 to a reduced vacuum pressure. Because chamber 206 remains at vacuum/subatmospheric pressure supplied by conduit 270 extending from T-junction 272 in conduit 268, a pressure differential across diaphragm 198 deflects the diaphragm, as shown in FIG. 11, so that cap 218 on plunger rod 200 bears against atmospheric vent 186 and opens vacuum chamber 222, thereby communicating vacuum/subatmospheric pressure to valve chamber 224 and therefore to valve housing 53 of discharge valve 24 and chamber 104 of water valve 34. Conduit 274 extending from vacuum reservoir 30 provides a source of vacuum/subatmospheric pressure at all times to vacuum chamber 222.

Figure 4:
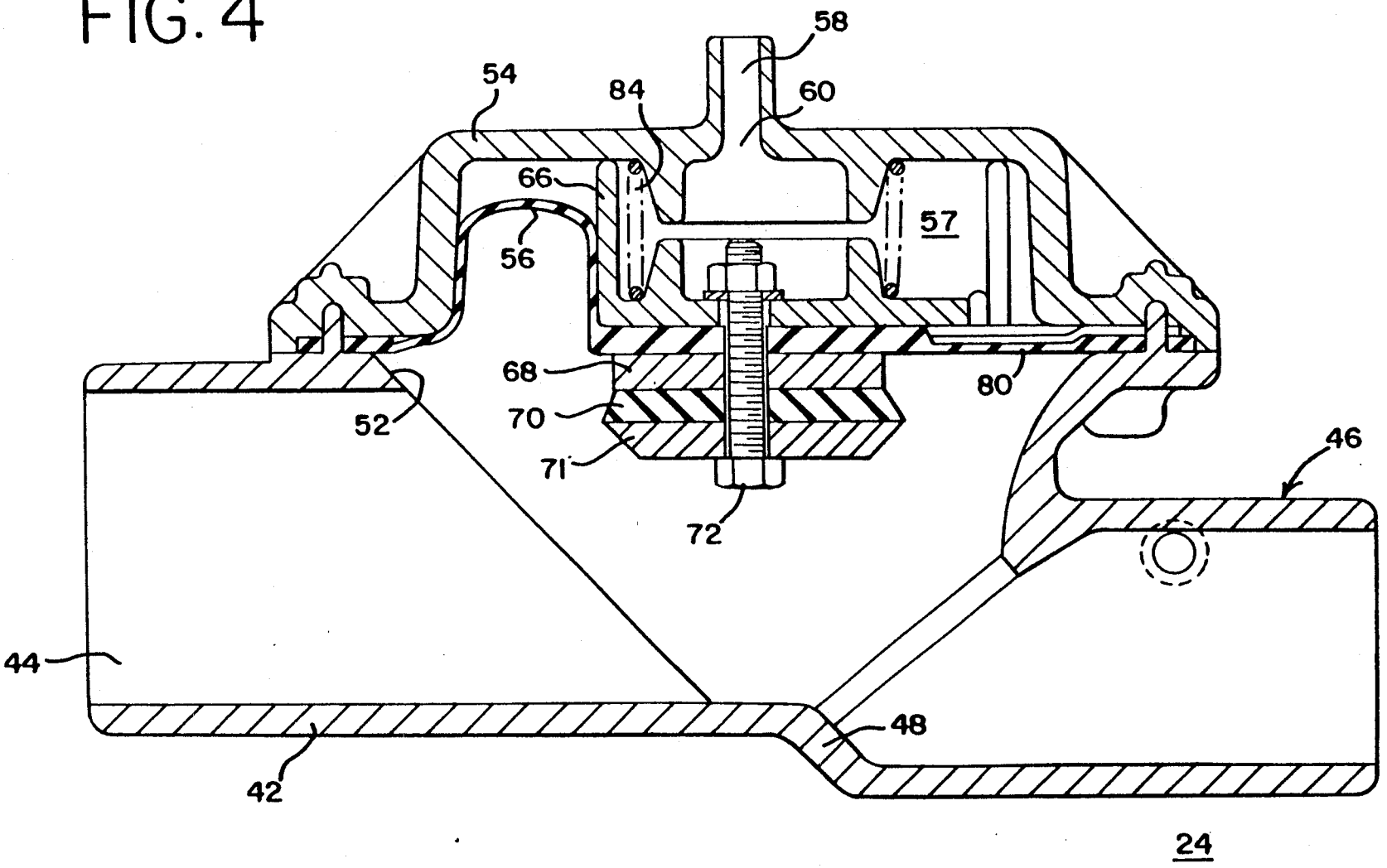
FIG. 4 shows a sectional view of the discharge valve of FIG. 3 in the open position.

The vacuum/subatmospheric pressure condition in valve housing 57 causes a differential pressure across diaphragm 56, thereby overcoming the force applied by spring 84. This causes the diaphragm to move to the actuated position shown in FIG. 4, thereby opening discharge valve 24 so that waste material in toilet bowl 14 can flow into pipe 26, and ultimately into vacuum transport conduit 22.

Figure 6:
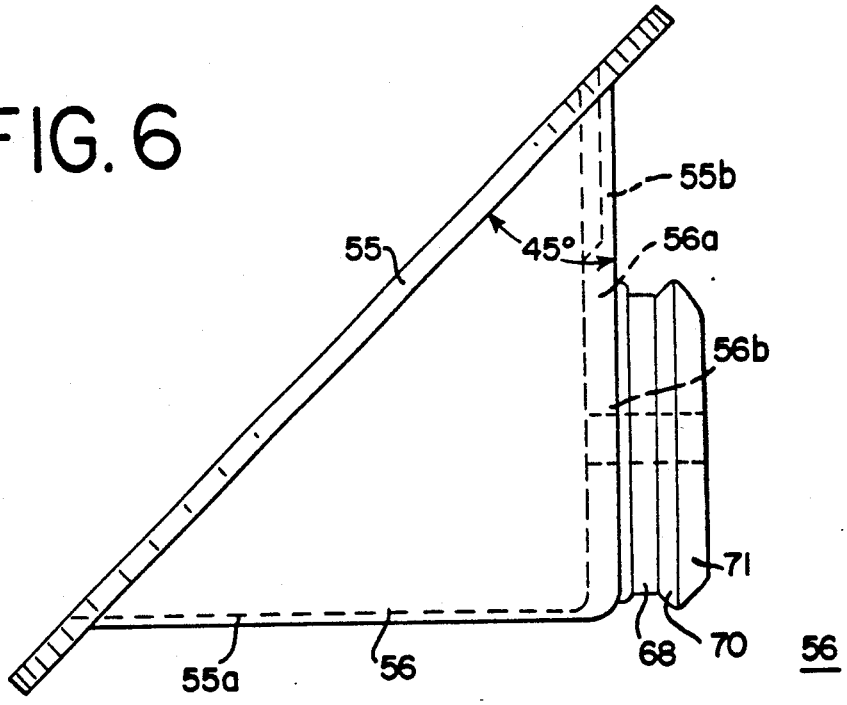
FIG. 6 shows a sectional side view of the diaphragm portion of the discharge valve shown in FIG. 5.
Figure 7:
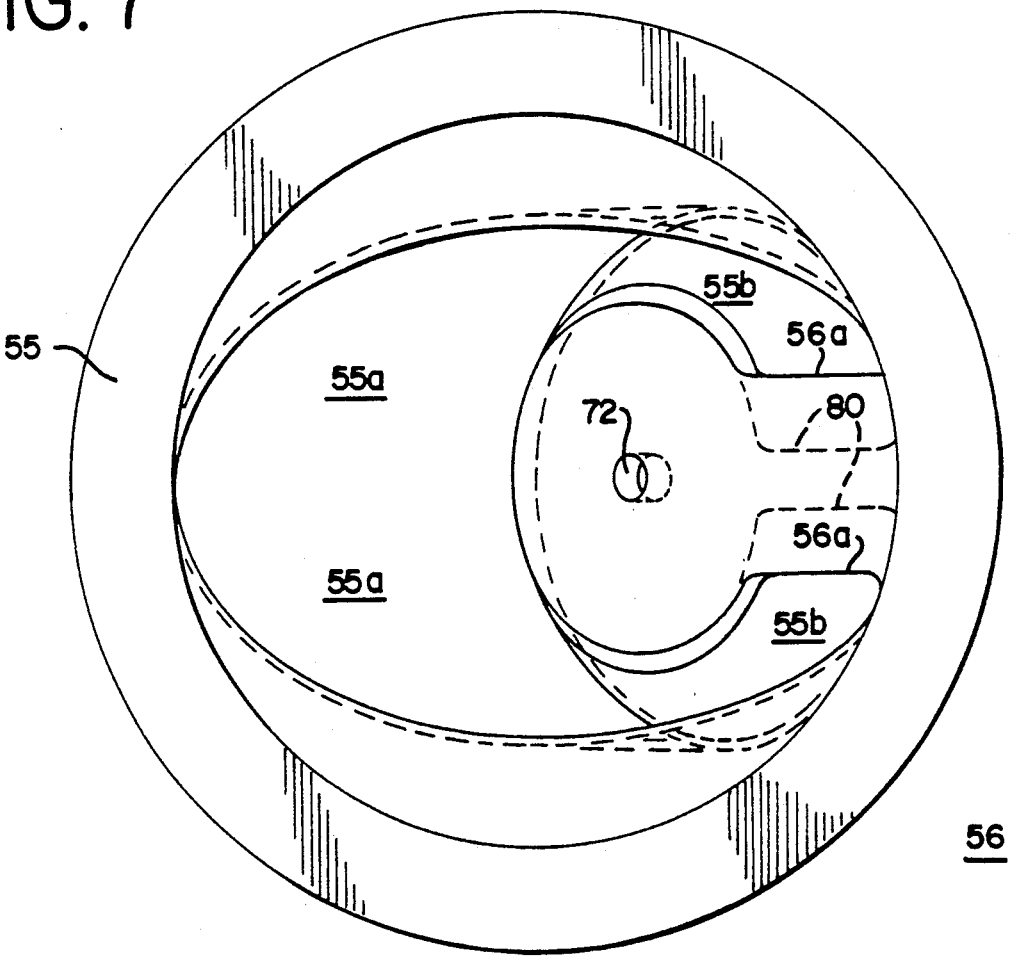
FIG. 7 shows a plan view of the diaphragm and valve seat of the discharge valve shown in FIG. 5.
Figure 9:
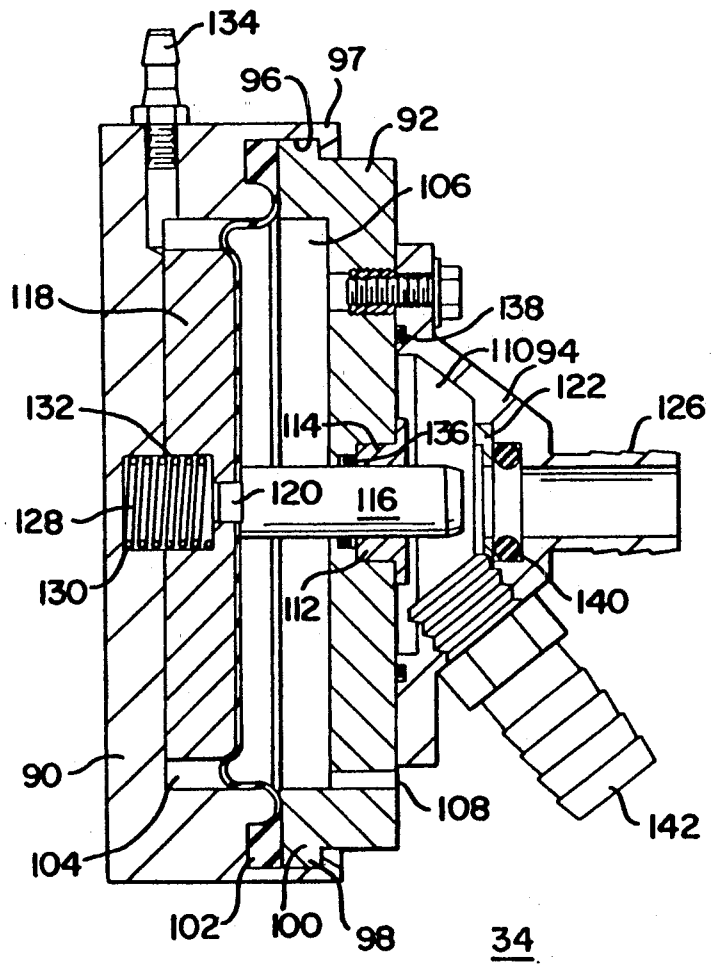
FIG. 9 shows a sectional view of the water valve of FIG. 8 in the open position.

At the same time, the vacuum/subatmospheric pressure introduced to chamber 104 of water valve 34 causes differential pressure across diaphragm 102 due to the atmospheric pressure delivered to chamber 106 due to atmospheric inlet 108. The force applied by spring 128 is overcome, and diaphragm 102 and plunger 116 moves away from gasket seal 140 to open water outlet 126, as shown in FIG. 6. Water in chamber 110 via water inlet 142 and hose 276 passes through water outlet 126, and hose 278 to spray ring 38, which discharges jets of water into toilet bowl 14, as is known in the art.

Because the increased atmospheric pressure in sensor chamber 197 deflecting diaphragm 192 and opening aperture 160, is quickly mixed with the vacuum/subatmospheric pressure condition in chamber 199 necessary to create the reduced vacuum condition to deflect diaphragm 198 by means of differential pressure, diaphragm 192 will be deflected from ring wall 162 only momentarily, and will quickly close against the ring wall to seal off chamber 199 once again. Vacuum/subatmospheric pressure from vacuum reservoir 30 and conduit 268 will bleed through needle valve 280 to slowly return chamber 199 to a vacuum/subatmospheric pressure condition. At this point in time, equalized pressure will be applied against diaphragm 198, and plunger rod 200 will return to the standby position shown in FIG. 7. Vacuum chamber 222 will be sealed off by end cap 218, and atmospheric pressure will once again be communicated to valve chamber 224, and therefrom into valve chamber 53 of discharge valve 28 and chamber 104 of water valve 34. Because equalized pressures are now applied against diaphragms 56 and 102 of discharge valve 28 and water valve 34, respectively, they will be returned to their standby conditions shown in FIGS. 3 and 8. Thus, waste material will be prevented from entering pipe 26 to conclude the flush cycle and water no longer will be delivered to spray ring 38. Therefore, needle valve 280 may be adjusted to regulate the duration of the flush cycle.

While the renewed atmospheric pressure condition is promptly communicated through conduit 260 to discharge valve 24, it is intentionally delayed in reaching water valve 34. This result occurs because a looped circuitry is interposed in conduit 262. T-junction 282 off of conduit 262 is connected in turn to conduits 284 and 286 before being rejoined by T-junction 288 before being connected to vent inlet 134 of water valve 34. Interposed in conduit 284 is needle valve 290, while check valve 292 is interjected in conduit 286. Therefore, when the atmospheric pressure in conduit 262 reaches T-junction 282, check valve 292 will prevent its transmission through conduit 286. Hence, it must travel through conduit 284 to water valve 34, but needle valve 290 restricts its passage. In this manner, water valve 34 is closed in response to the atmospheric pressure condition communicated by controller valve 28 a predetermined amount of time after discharge valve 24 is closed, thereby permitting toilet bowl 14 to be filled with a preset volume of water after closure of the discharge valve and conclusion of the flush cycle.

During the flush cycle, vacuum/subatmospheric pressure in conduit 284 is communicated to push button actuator 42 via T-junction 294, conduit 296, and T-junction 264 to hold bellows 248 in the compressed state. This ensures that push button 252 is maintained in the depressed state to prevent repeated pushing thereof and cycling of the vacuum toilet system 10 by the user. However, once atmospheric pressure is communicated through conduits 266 and 284, it passes through T-junction 294 and conduit 296 to reinflate bellows 248 to return push button 252 to its standby position shown in FIG. 12. This simplified design provides an improvement over a vacuum toilet system sold by Evac in which the push button actuator returns immediately to the standby position after being depressed, and internal circuitry in the controller valve is required to prevent reinitiation of a new flush cycle while another flush cycle is in progress.

Orifice 298 interposed in conduit 296 restricts flow to water valve 34 of the compressed atmospheric air from push button actuator 42, thereby ensuring that most of it is communicated to controller valve 28 to commence a flush cycle as previously described.

While push button actuator 42 is shown mounted to the side of china cabinet 12 in FIG. 2, it is removed a sufficient distance from the cabinet in a preferred embodiment of the present invention so that it may not be pushed while a user is seated on the toilet seat 16. This avoids the unfortunate results that may occur if an overly ample individual is seated on the vacuum toilet during the flush cycle.

While particular embodiments of the invention have been shown and described, it should be understood that the invention is not limited thereto, since many modifications may be made. The invention is therefore contemplated to cover by the present application any and all such modifications which fall within the true spirit and scope of the basic underlying principles disclosed and claimed herein.

What is claimed is:

1. A discharge valve for a vacuum toilet system having an open position and a closed position, said discharge valve comprising:

(a) a valve body having an entry opening and an exit opening, and defining a valve housing having a longitudinal axis generally normal to axes defined by the entry and exit openings;

(b) a valve stop in said valve body not located along the longitudinal axis of the valve housing;

(c) a valve plunger disposed within the valve housing for reciprocating movement relative to said valve stop to alternatively open and close said discharge valve in response to a pressure condition communicated to said discharge valve, said plunger having a first end and a second end opposite said first end, said valve plunger having seating means connected to the first end of said plunger matable with said valve stop to provide liquid and air-tight closure of said discharge valve when it is in the closed position, a piston operator being operatively connected to the second end of said valve plunger; and (d) control means operatively connected to said valve plunger for regulating the reciprocated movement of said valve plunger in an arc between the open and closed positions of said discharge valve.

2. A discharge valve as recited in claim 1, wherein said piston operator comprises a flexible diaphragm dividing a piston chamber from the valve housing, a piston cup connected to said diaphragm and having securement means attached thereto, a spring disposed between said piston cup securement means and a second securement means connected to the upper interior surface of the piston housing to bias said valve plunger against said valve stop, said valve plunger being removed from said valve stop by said piston operator once a pressure condition is communicated to said plunger housing that applies differential pressure across said diaphragm.

3. A discharge valve as recited in claim 2, wherein the securement means of the piston cup and said piston housing are located in a nonconcentric relation when the valve plunger is positioned against said valve stop in order to facilitate the arced reciprocating movement of said valve plunger.

4. A discharge valve as recited in claim 1, wherein said control means comprises a flexible strip connected at its first end to said valve plunger and at its second end to said valve body.

5. A discharge valve as recited in claim 4, wherein said piston operator is fixed in a nonconcentric relation with the longitudinal axis of said valve housing whereby said valve plunger moves in an arc defined by said flexible strip when reciprocated between the open position and closed position to permit a smaller piston housing.

6. A discharge valve as recited in claim 2, wherein said control means comprises a reinforced area along said diaphragm.

7. A discharge valve as recited in claim 6, wherein said piston operator is fixed in nonconcentric relation with the longitudinal axis of the valve housing whereby said valve plunger moves in an arc when reciprocated between the open position and closed position as defined by the reinforced area along said diaphragm to permit a smaller valve housing.

* * * * *